US006272696B1

(12) United States Patent
Sobel et al.

(10) Patent No.: US 6,272,696 B1
(45) Date of Patent: Aug. 14, 2001

(54) HINGED TOP RAIL FOR ABOVE-GROUND POOL AND METHOD OF POOL ASSEMBLY USING SAME

(75) Inventors: Richard Mark Sobel, Old Field, NY (US); James C. Wickstead, Mendham, NJ (US)

(73) Assignee: Wil-Bar International, Inc., Hauppauge, NY (US)

( * ) Notice: Subject to any disclaimer, the term of this patent is extended or adjusted under 35 U.S.C. 154(b) by 0 days.

(21) Appl. No.: 09/669,491

(22) Filed: Sep. 25, 2000

(51) Int. Cl.[7] ..... E04H 4/04
(52) U.S. Cl. ..... 4/506
(58) Field of Search ..... 4/506, 488; 52/169.1, 52/69, 300

(56) References Cited

U.S. PATENT DOCUMENTS 3,351,958 * 11/1967 Shields ..... 4/506
3,500,605 * 3/1970 Katzman ..... 4/506
3,869,736 * 3/1975 Valois et al. ..... 4/506
4,062,158 * 12/1977 Kaufmann et al. ..... 4/506
4,137,576 * 2/1979 Greene ..... 4/506
5,155,872 * 10/1992 Aymes ..... 4/506
5,907,875 * 6/1999 Yurchision et al. ..... 4/506

FOREIGN PATENT DOCUMENTS

1133874 B1 * 7/1962 (DE) ..... 4/506

* cited by examiner

*Primary Examiner*—Charles R. Eloshway
(74) *Attorney, Agent, or Firm*—Herold and Haines, P.A.; Brian L. Wamsley, Esq.

(57) ABSTRACT

A frame for portable above-ground swimming pools and, more particularly, a frame for above-ground swimming pools having a top rail, formed in sections, that is pivotally attached to the frame vertical supports. Each top rail section is installed at the top of the vertical supports in a vertical position that is about 90° from a horizontal axis, allowing access to the interior area of the pool frame for installation and attachment of the sheet metal swimming pool wall. Once the top rails sections are assembled, the frame is free-standing and the pool wall may be installed and attached to the frame without partial disassembly of the frame or removal and replacement of the top rail sections. Once the swimming pool wall and liner are installed, the top rail sections are rotated 90° along the horizontal axis, securing the wall and liner, and are locked into place. The invention further provides a method for installing an above-ground swimming pool in the sequential steps described above.

11 Claims, 4 Drawing Sheets

HINGED TOP RAIL FOR ABOVE-GROUND POOL AND METHOD OF POOL ASSEMBLY USING SAME

The present invention relates generally to above-ground portable swimming pools specifically adapted to be easily and quickly assembled and disassembled. More particularly, the invention relates to an above-ground swimming pool having a segmented top rail that pivots or is hinged, and a sequential method of assembling an above-ground pool using the segmented, hinged top rails.

BACKGROUND OF THE INVENTION

The present invention relates to the construction of above-ground swimming pools and provides an easier, simpler and faster method for above-ground pool assembly, disassembly and re-assembly. A number of prior art configurations and methods of construction and installation are known for above-ground swimming pools. Typically, such pools are comprised of a generally circular, rigid support frame having a continuous sheet metal wall attached above the periphery of the circular frame. The support frame is comprised of vertical supports positioned at intervals around the sheet metal wall, and attached at the base to a circular bottom channel or rail. A flexible pool liner is disposed within the wall and support frame forming a basin to hold the water. The pool liner is secured at the top of the wall by a circular top channel, which is in turn covered by a top rail attached to the top of the vertical supports and the sheet metal wall. The top channel thus functions to retain the pool liner while also providing some structural support to the pool wall. The top rail, attached to the vertical supports, completes the structural support necessary to hold the wall in place. Although above-ground pools of such construction serve their primary recreational purpose, they are not configured to be easily assembled or disassembled for servicing, liner replacement or repair, or for moving the pool to an alternate location.

A variety of portable above-ground pools are known in the prior art, such pools share common design defects that make assembly both cumbersome and time-consuming. Installation of above-ground swimming pools requires constructing the sheet metal wall, which holds the water, and constructing the frame, which holds the wall. Typically, the wall and the frame are erected at the same time because neither the wall nor the frame are self-supporting under most circumstances. Sections of the wall and parts of the frame need to be held, or temporarily secured, in order to keep them from falling down during installation and assembly. This normally requires the assistance of several people. The pool achieves its rigidity after it is fully assembled.

Often, however, part of the frame is erected in order to hold the wall in place, but later in the process the frame must be partially disassembled for installation of other parts, such as the pool liner. For example, for above-ground pools having a continuous sheet metal wall configuration, installation of the pool entails unraveling the wall a little at a time while inserting it into the bottom rail of the frame. If the entire wall becomes unraveled all at once, installation becomes much more difficult. Nevertheless, as the wall becomes unraveled it must be supported in some manner before the frame is assembled.

Once the wall is erected and installed in the frame bottom rail, it must be stabilized while the remainder of the frame is assembled around it. This is generally accomplished using landscaping stakes, temporarily installed stabilizer rails and uprights, or helpers. Next, the vertical supports are attached to the bottom channel. The top channel is then placed on the top of the pool wall and, sometimes, stabilizer plates or the top rail is installed for additional rigidity of the pool wall. Assembly of the frame also requires the use of fasteners and screws to hold the frame elements together. Many of these fasteners must be removed at a later stage for installation of the pool liner.

The pool liner is installed next. This requires all parts placed on top of the pool wall to be removed, together with fasteners and screws, as the liner must be placed on the top of the pool wall. Thus, the frame must be partially disassembled and then reassembled after the liner is installed. Further, in the same manner the frame must also be partially disassembled to remove the liner for repair or replacement. It would therefore be desirable to have a portable, above-ground swimming pool where the wall is essentially self-supporting, and where the frame does not have to be partially disassembled to install or remove the pool liner.

It is therefore an object of the present invention to provide an above-ground swimming pool where the frame may be assembled without the aid or support of the wall, and also without screws or fasteners. It is a further object of this invention to provide a method of assembly where the pool wall is installed after the frame is constructed, so that the pool wall can be secured by the frame obviating the need for additional assistance or support devices.

It is also an object of this invention to provide an above-ground swimming pool frame where the top channel and top rail do not have to be removed during installation for installation of the pool liner. It is a further object of this invention to provide a top rail that can facilitate the removal and replacement of the pool liner.

SUMMARY OF THE INVENTION

In accordance with the preferred embodiment of the present invention, there is provided a portable, above-ground swimming pool which may be easily assembled, disassembled and reconstructed. The pool generally comprises a frame portion having a circular bottom channel where the sheet metal pool wall is installed, vertical supports and a top rail. The frame is self-supporting and does not require installation of the wall for support. Thus, the frame is capable of being fully assembled prior to the installation of the wall. Moreover, the frame according to this invention does not need to be partially disassembled in order to install the swimming pool wall or the pool liner.

The capabilities of the present invention are accomplished by the design of the pool top rail which, when attached to the tops of the vertical supports, allows the installation of the pool wall and liner without requiring the removal of the top rail itself. The top rail of this invention is comprised of a series of radial arc segments, the full complement of which makes up the entire 360° circumference of the pool. Each rail segment has two ends which are attachable at each end to the top end of a vertical support. The ends of each rail segment function as hinges, and are inserted into the top of the vertical supports in a vertical or perpendicular position. Once the rail segment is installed onto the vertical supports, the segment may be pivoted or swiveled on a horizontal axis from a "flat" or horizontal position, to a vertical or upright position.

Pivoting the top rails segments to the upright position permits access to the inner side of the pool frame such that the pool wall may be installed into the frame after the frame has been assembled. In addition, the top of the pool wall is easily accessible after it has been installed when the top rail segments are in the upright position so that the pool liner may be further installed. Once the liner has been installed, a top channel is placed over the pool liner at top of the of the pool wall to secure the liner. The top rail segments are then pivoted to their horizontal position, completing the pool installation.

Thus, in accordance with the present invention, an above-ground swimming pool is assembled in the following manner and sequence. The circular frame is first constructed by placing the circular bottom rail on the ground and then attaching a plurality of vertical supports to the bottom channel at predetermined positions. While the vertical supports are being attached to the bottom channel, top rail segments can be concurrently attached to the upper ends of the vertical supports. In this manner, all of the vertical supports and top rail segments are installed, completing the circumference of the pool.

BRIEF DESCRIPTION OF THE DRAWINGS

The above objects and advantages of the invention will become manifest to one skilled in the art from considering the following detailed description of an embodiment of the invention in light of the accompanying drawings, in which.

DETAILED DESCRIPTION OF THE INVENTION

Figure 1:
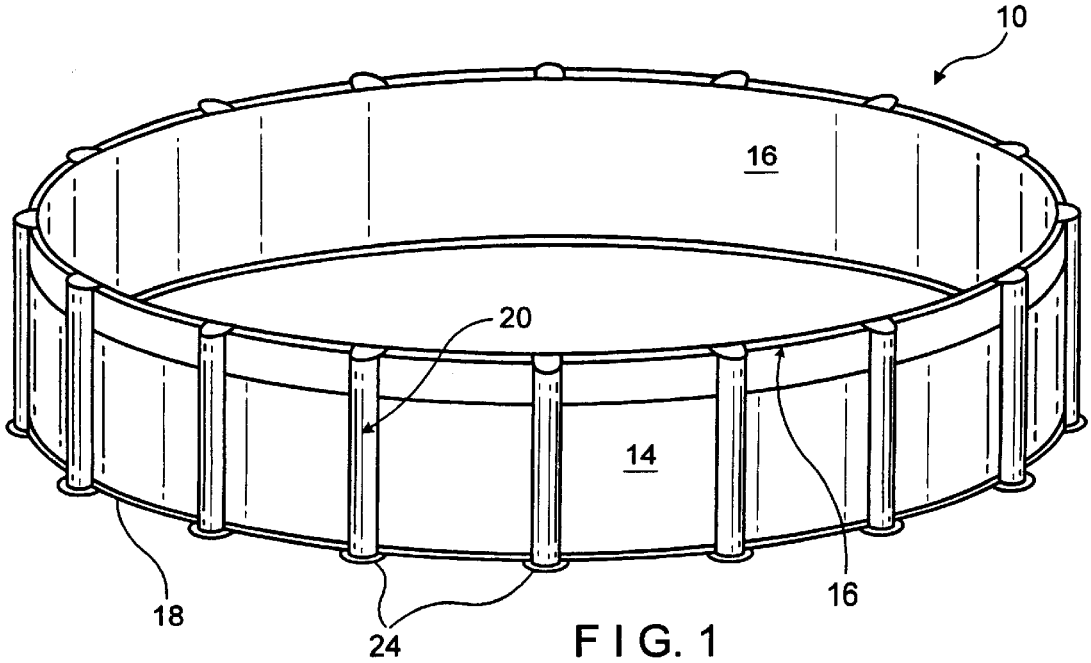
FIG. 1 is a perspective view of the portable swimming pool of the present invention after partial assembly thereof, with the top rail segments partially in the final position.

Referring now to the drawings wherein the showings are for the purpose of illustrating a preferred embodiment of the present invention and not for purposes of limiting the same, FIG. 1 perspectively illustrates the portable pool assembly of the above invention. By its design and construction, pool assembly 10 is intended to serve only as an above-the-ground swimming pool. Pool assembly 10 generally comprises a frame portion 12 (see FIG. 2), and a sheet-metal pool wall 14 which is adapted to be secured to the frame portion 12. Frame portion 12 is constructed of any type of moldable plastic generally known to the art to be suitable for such purpose, for example, PVC or the like. A pool liner 16 (see FIG. 5) for forming a basin to hold the water, is provided inside the pool wall 14 and is generally attached at the top of pool wall 14.

Figure 2:
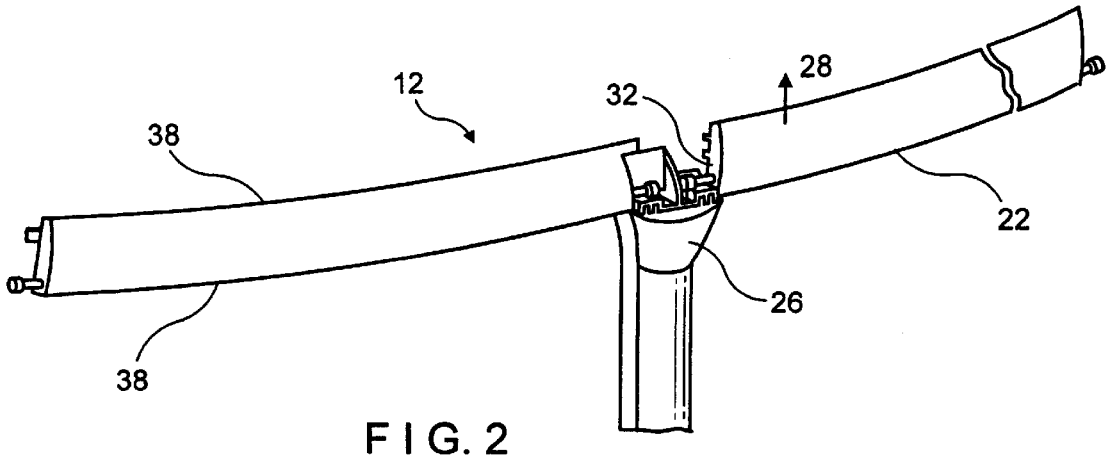
FIG. 2 is a sectional view of one segment of the portable swimming pool, with the top rails in the perpendicular position.
Figure 3:
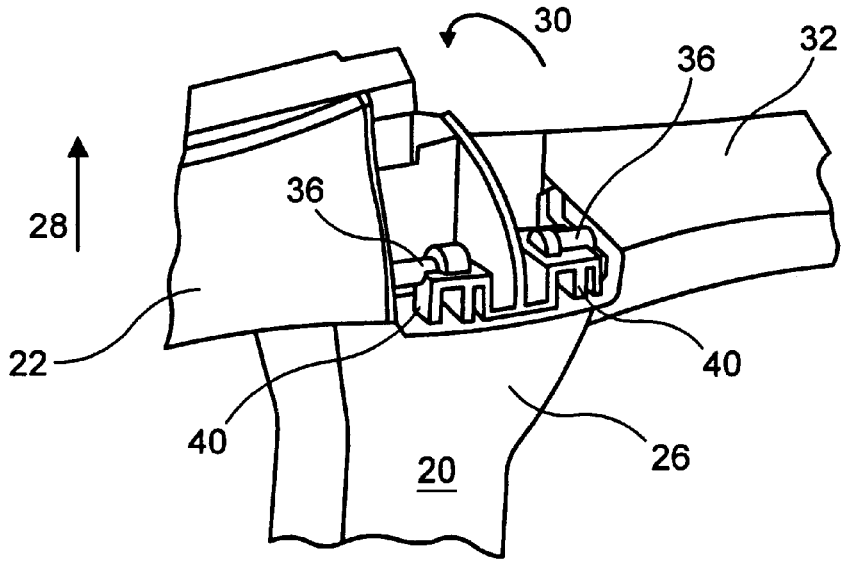
FIG. 3 is a detailed view of the hinge end of a top rail segment.

Referring to FIGS. 1–3, the frame portion 12 comprises a bottom rail 18, a plurality of vertical supports 20 and a plurality of top rail segments 22. As above-ground pools are preferably circular in shape, the bottom rail 18 forms a circumferential foundation for the pool with the plurality of vertical supports 20 being provided at selected intervals and attached to the bottom rail. Top rail segments 22 corresponding with arc sections 24 formed between the vertical supports 20. The ends of the top rails segments 22 are pivotably inserted into top end portions 26 of the vertical supports 20. The top rail segments 22 are first installed into the vertical supports 20 in an upright or perpendicular position as shown by the direction of arrow 28. Once the pool wall 14 is installed into the frame 12 and liner 16 is installed on wall 14, along with other liner installation components, each top rail segment 22 is rotated 90° to a flat or horizontal position along horizontal axis 32, thus locking in the pool wall 14 with attached liner 16 and providing further structural support to the pool assembly 10. FIG. 1 illustrates partial installation of top rails segments 22, showing some of the top rail segments 22 in the perpendicular position and some in the horizontal position.

Figure 4:
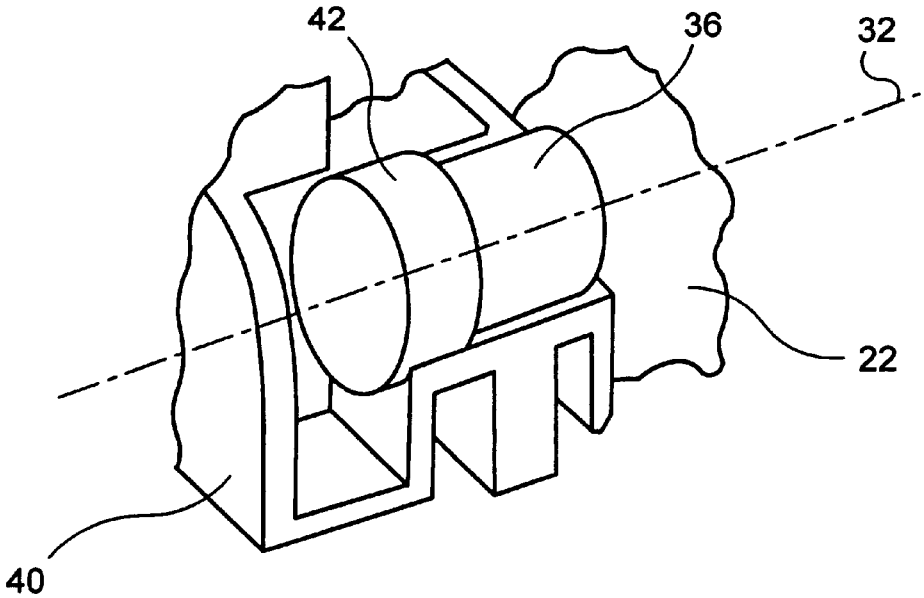
FIG. 4 is a detailed sectional view of the present invention with a top rail segment in the closed or horizontal position and a top rail segment in the open or perpendicular position.

The ability of each top rail segment 22 to pivot 90° on horizontal axis 32 allows frame portion 12 to be completely assembled prior to attaching pool wall 14 to the frame 12, and without requiring partial disassembly of the frame 12. This ability is provided by the configuration of the ends the top rail segments 22, as shown in detail in FIGS.3–4. Each top rail segment 22 has two end portions, each of which comprises a pin 36 axially disposed along axis 32. As shown in the preferred embodiment, the top rail segments 22 are of an elongated flat design, having a width dimension and a length dimension, with an edge 38 on each side of the length dimension. Preferably, pins 36 are positioned on the ends near one edge of the top rail segment 22, so when the segment is pivoted, the entire width of the top rail segment 22 is rotated.

The pins 36 are inserted in corresponding cups 40 located in the top end portion 26 of each vertical support 20. The cups 40 are cylindrically configured to receive the pins 36 along axis 32, allowing the pins 36 to rotate on that axis. Each top end portion 26 has two cups 40 placed 180° apart along axis 32, for receiving the pins 36 of two top rail segments 22. Pins 36 further comprise a circular flange 42 at the ends thereof, to retain the pins 36 in the cups 40 after assembly. A locking means 44 is further positioned on the ends 32 of top rail segments 22, which function to hold the top rail segments 22 in the horizontal or closed position.

Figure 6:
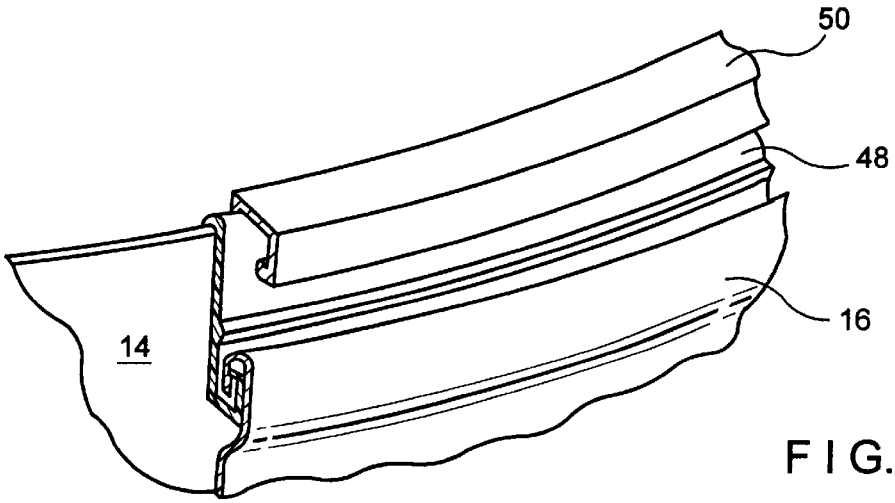
FIG. 6 is a view of an overlap pool liner installation.
Figure 5:
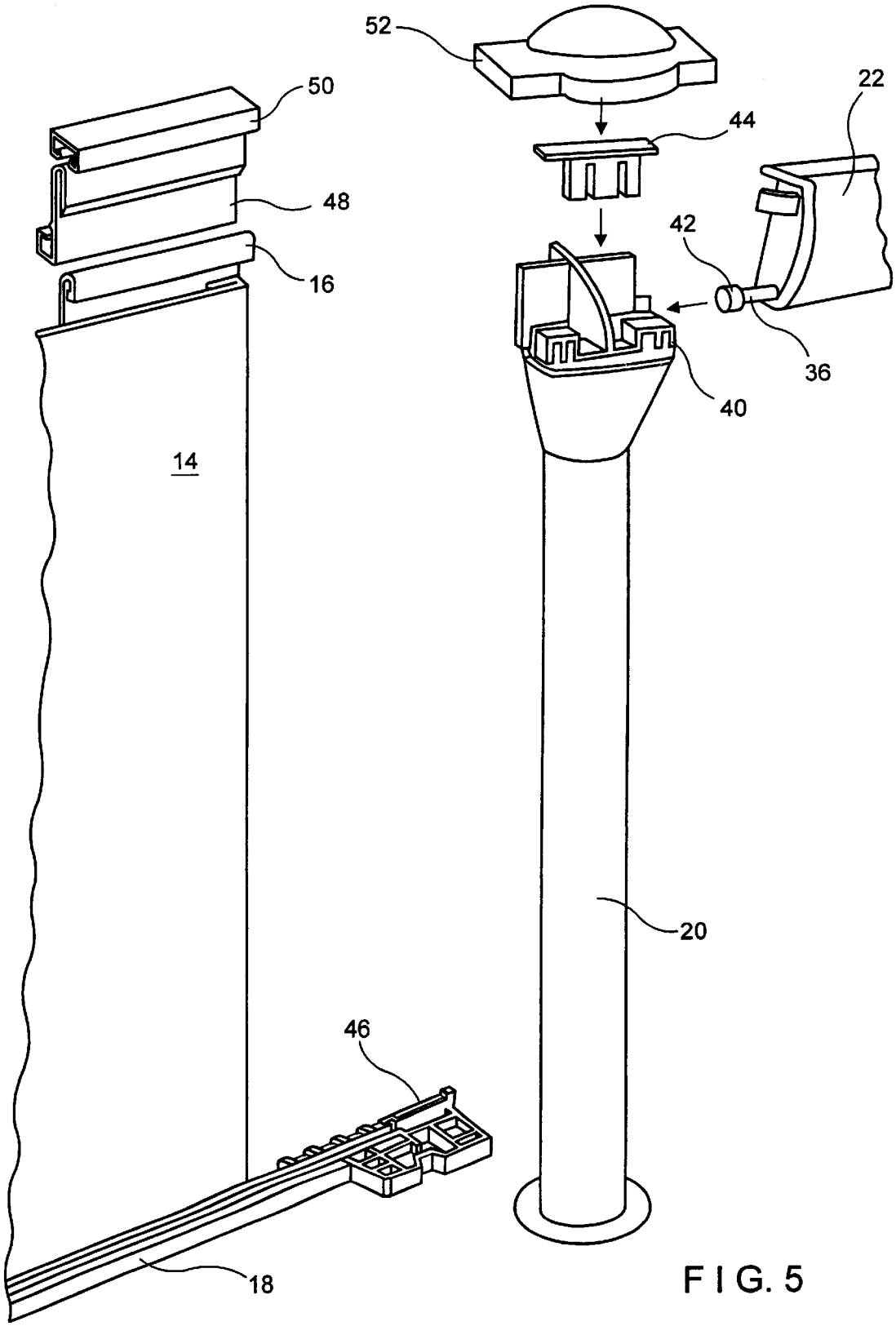
FIG. 5 is an exploded view of the assembly a segment of the pool of the within invention.
Figure 7:
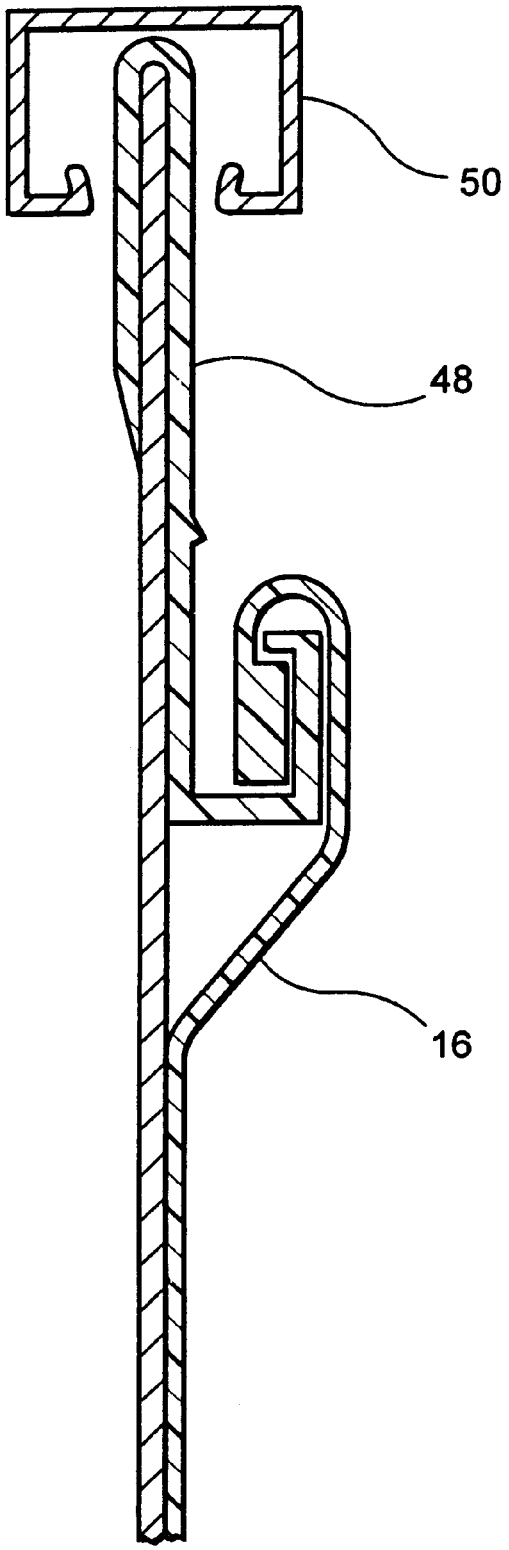
FIG. 7 is a view of a beaded pool liner installation.

FIG. 5 illustrates an exploded view of the assembly of a segment of the preferred embodiment of the invention. Bottom rail segments 18 clip together to form the foundation of the frame, at junctions that function as holders 46 for the vertical supports 20. The vertical supports 20 clip into the support holders 46. The top rail segments 22 then clip into the cups 40 on the upper ends 26 of the vertical supports. Preferably, top rail segments 22 are inserted in the upright or perpendicular position as shown in FIGS. 2 and 3. If they are installed in a horizontal position, they may be rotated 90° to the perpendicular to facilitate installation of the pool wall 14 and pool liner 16. Once the top rail segments 22 are installed, the frame 12 is free-standing and has sufficient structural strength to enable attachment of the pool wall 14 to vertical supports 20. Then, pool liner 16 is installed inside the pool wall 14 and hung over the top edge of the pool wall 20. A plastic coping 48 piece is then clipped over the edge of pool liner 16, followed by an inner stabilizer rail 50. Stabilizer rail 50 functions to finish the top edge of the pool wall. FIG. 6. Presents a more detailed view of the liner 16 installation.

Once the liner 16, coping 48 and stabilizer rail 50 are installed, the top rail segments 22 are pivoted into a horizontal position and locked into place by clip 44. A flexible resin cap 52 fits over the clip 44 and top rail assembly 22, to complete the installation.

While the present invention has been explained in relation to its preferred embodiment, it is to be understood that various modifications thereof will be apparent to those skilled in the art upon reading this specification. Thus, the particular combination of parts that comprise the invention disclosed herein is therefore intended to cover all such modifications and not intended to serve as limitations of alternative devices that fall within the scope of the appended claims.

What is claimed is:

1. An above-ground swimming pool frame assembly, comprising;

a bottom frame member forming a continuous foundation for the frame assembly;

a plurality of connecting means disposed at intervals along the bottom frame member;

a plurality of substantially rigid, elongated support members having a top end and a bottom end, wherein the support members are removably attached at the bottom ends to the connecting means of the bottom frame member in a vertical position, a plurality of substantially rigid, elongated top frame members having two ends, each top frame member end being configured for pivotable attachment to the top ends of the support members, wherein the top frame member ends are pivotably attached to the support members such that each top frame member can pivot at least 90° along a horizontal axis from a substantially vertical position to a substantially horizontal position.

2. The swimming pool frame assembly of claim 1, further comprising a plurality of locking means for locking the top frame members when in the substantially horizontal position.

3. The swimming pool frame assembly of claim 1, wherein the top frame member ends comprise a pin and a circular flange for removable, pivotable attachment to the support members.

4. The swimming pool frame assembly of claim 1, wherein the top ends of the support members comprise means for receiving the ends of the top frame members.

5. The swimming pool frame assembly of claim 1, wherein the frame assembly is manufactured of moldable plastic material.

6. A method of installing a portable, above-ground swimming pool, comprising the steps of:

assembling a free-standing frame portion of the swimming pool, comprising the steps of;

assembling a bottom rail portion which defines the periphery of the swimming pool and provides a foundation for the frame portion;

attaching a plurality of vertical supports to the bottom rail portion at predetermined positions along the bottom rail portion;

attaching a plurality of elongated top rail members to top ends of the vertical supports, wherein the top rail members are pivotally connected to the vertical supports along a horizontal axis and are attached in a vertical position with respect to the horizontal axis that allows access to an inner side of the vertical supports;

attaching a sheet metal pool wall to the inner side of the vertical supports;

installing a swimming pool liner on an inner side of the sheet metal wall;

installing means for securing the pool liner to the sheet metal wall; and individually pivoting each top rail member about 90° along the horizontal axis into a horizontal position such that it secures the sheet metal wall with the installed pool liner.

7. The method of claim 6 wherein the top rail members are not removed after they are attached to the vertical supports and prior to attaching the sheet metal wall to the vertical supports.

8. The method of claim 7, further comprising the step of attaching means to the top ends of the vertical supports for locking the top rail members in the horizontal position.

9. The method of claim 8 wherein the locking means comprises a plastic clip.

10. The method of claim 8, further comprising the step of attaching covering means to the top ends of the vertical supports.

11. The method of claim 7 wherein the means for securing the pool liner to the sheet metal wall comprise a plastic coping element and a stabilizer element.

* * * * *